US009388013B2

(12) United States Patent
Onishi

(10) Patent No.: US 9,388,013 B2
(45) Date of Patent: Jul. 12, 2016

(54) SHEET DISCHARGING DEVICE AND IMAGE FORMING APPARATUS PROVIDED WITH SAME

(71) Applicant: KYOCERA Document Solutions Inc., Osaka-shi, Osaka (JP)

(72) Inventor: Yuzo Onishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/249,603

(22) Filed: Apr. 10, 2014

(65) Prior Publication Data

US 2014/0306402 A1 Oct. 16, 2014

(30) Foreign Application Priority Data

Apr. 10, 2013 (JP) ..... 2013-081868

(51) Int. Cl.
*B65H 31/26* (2006.01)
*B65H 29/52* (2006.01)
*B65H 31/02* (2006.01)

(52) U.S. Cl.
CPC ..... *B65H 31/26* (2013.01); *B65H 29/52* (2013.01); *B65H 31/02* (2013.01); *B65H 2301/4212* (2013.01); *B65H 2301/5133* (2013.01); *B65H 2401/15* (2013.01); *B65H 2404/61* (2013.01); *B65H 2404/63* (2013.01); *B65H 2511/13* (2013.01); *B65H 2511/17* (2013.01); *B65H 2511/20* (2013.01); *B65H 2515/81* (2013.01); *B65H 2801/06* (2013.01)

(58) Field of Classification Search
CPC ..... B65H 2801/06; B65H 31/02; B65H 2301/5133; B65H 33/08; B65H 31/26; B65H 29/40; B65H 2701/1912; G03G 15/6552
USPC ..... 271/207, 208, 209, 213, 220, 176
See application file for complete search history.

(56) References Cited

U.S. PATENT DOCUMENTS

2011/0198801 A1* 8/2011 Yamaguchi ..... 271/207
2012/0049441 A1* 3/2012 Kimura et al. ..... 271/177

FOREIGN PATENT DOCUMENTS

JP 6-199461 * 7/1994
JP 2004-115254 4/2004
JP 2004-123395 4/2004

OTHER PUBLICATIONS

Japanese Patent Appl. No. 2013-081868—Office Action issued Jun. 30, 2015.

* cited by examiner

*Primary Examiner* — Thomas Morrison
(74) *Attorney, Agent, or Firm* — Gerald E. Hespos; Michael J. Porco; Matthew T. Hespos

(57) ABSTRACT

A sheet discharging device discharges a sheet to a sheet tray on which the sheet is to be placed. The sheet discharging device includes a discharge path configured to discharge the sheet to the sheet tray, a discharging portion arranged in the discharge path and configured to discharge the sheet passing along the discharge path to the sheet tray, and a pressing member capable of changing a posture between a hanging posture where the pressing member hangs down from a pivot center above the discharge path so as to block the discharge path for the sheet and a retracted posture where the pressing member is pivoted in a discharging direction about the pivot center to open the discharge path by receiving a pressing force in the discharging direction from the sheet. The pressing member includes an attaching portion to which a weight member having a predetermined weight is attachable.

12 Claims, 11 Drawing Sheets

SHEET DISCHARGING DEVICE AND IMAGE FORMING APPARATUS PROVIDED WITH SAME

This application is based on Japanese Patent Application Serial No. 2013-81868 filed with the Japan Patent Office on Apr. 10, 2013, the contents of which are hereby incorporated by reference.

BACKGROUND

The present disclosure relates to a sheet discharging device for discharging a sheet to a sheet tray and an image forming apparatus provided with the same.

Generally, a sheet tray to which a sheet having an image formed thereon is to be discharged is arranged in an image forming apparatus such as a copier, a printer, a facsimile machine or a complex machine provided with these functions. The sheet having the image formed thereon is discharged to the sheet tray through a discharge opening by a discharge roller arranged above the sheet tray.

If a sheet is curled, the trailing end of the sheet discharged from the discharge roller may be lifted to close the discharge opening. Accordingly, there is known a technique for preventing the lift of the trailing end of a sheet by pressing an end part of a plate-like Mylar member against the sheet and pressing the sheet downward at a position within a predetermined distance from opposite ends of the sheet.

However, a lift amount of the sheet differs depending on properties of the sheet such as the thickness of the sheet, the hardness of the sheet and the easiness to curl of the sheet. Thus, in the case of pressing a sheet with a constant pressing force as in the above technique, depending on the properties of the sheet, the pressing force may be insufficient, whereby the sheet may be lifted or an excessive pressing force may be applied to cause the bending of the sheet or a sheet jam, thereby causing trouble in discharging the sheet.

The present disclosure aims to provide a sheet discharging device and an image forming apparatus capable of easily adjusting a pressing force applied to a sheet according to properties of the sheet.

SUMMARY

A sheet discharging device according to one aspect of the present disclosure is for discharging a sheet to a sheet tray on which the sheet is to be placed and includes a discharge path, a discharging portion and a pressing member. The discharge path is for discharging the sheet to the sheet tray. The discharging portion is arranged in the discharge path and discharges the sheet passing along the discharge path to the sheet tray. The pressing member is capable of changing a posture between a hanging posture where the pressing member hangs down from a pivot center above the discharge path so as to block the discharge path for the sheet and a retracted posture where the pressing member is pivoted in a discharging direction about the pivot center to open the discharge path by receiving a pressing force in the discharging direction from the sheet. The pressing member includes an attaching portion to which a weight member having a predetermined weight is attachable.

Further, an image forming apparatus according to another aspect of the present disclosure includes a sheet tray on which a sheet is to be placed, the above sheet discharging device and an image forming unit for forming an image on the sheet. The sheet discharging device discharges the sheet having the image formed thereon by the image forming unit to the sheet tray.

These and other objects, features and advantages of the present disclosure will become more apparent upon reading the following detailed description along with the accompanying drawings.

DETAILED DESCRIPTION

Figure 1:
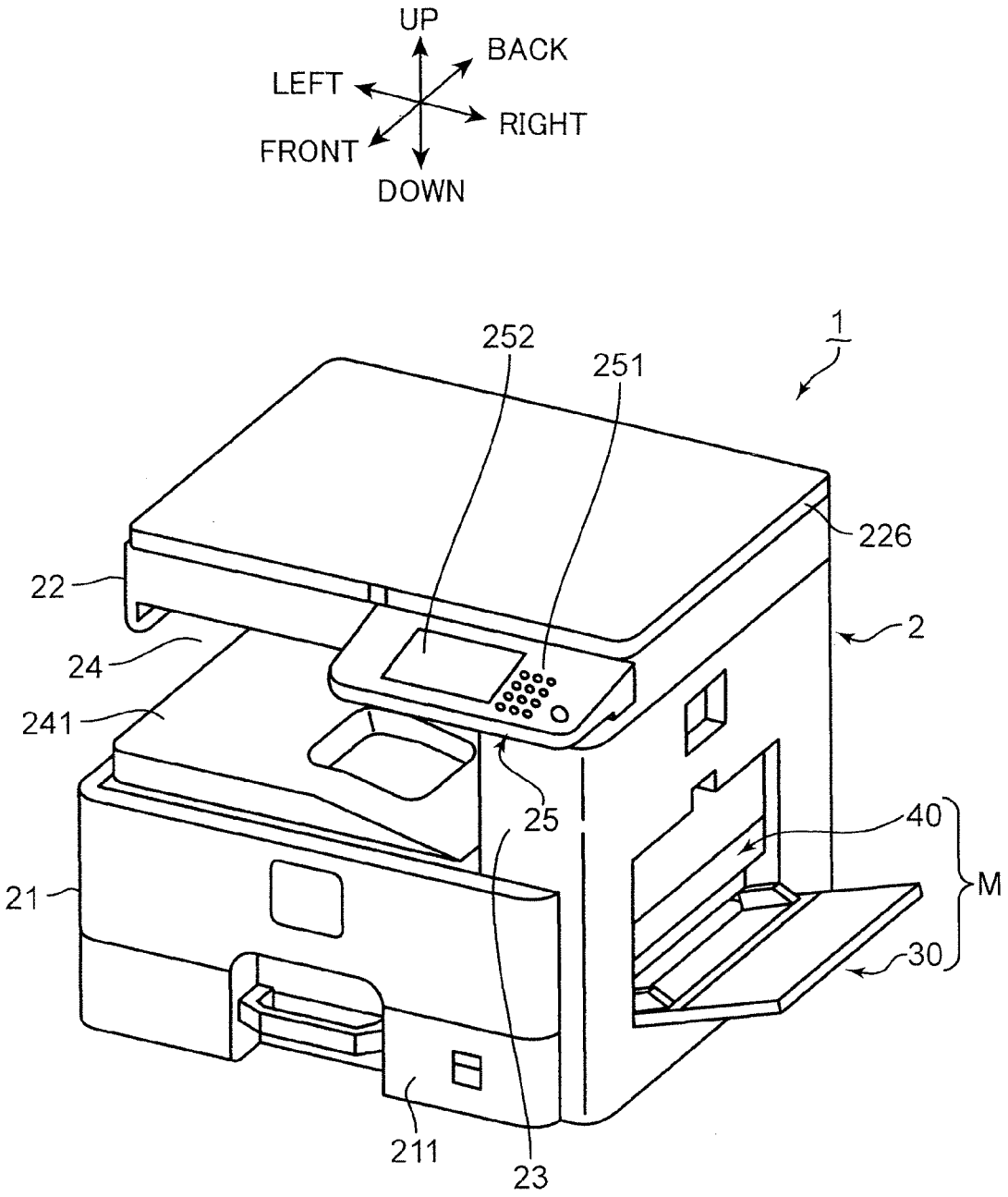
FIG. 1 is a perspective view showing the external appearance of an image forming apparatus provided with a sheet discharging device according to one embodiment of the present disclosure.
Figure 2:
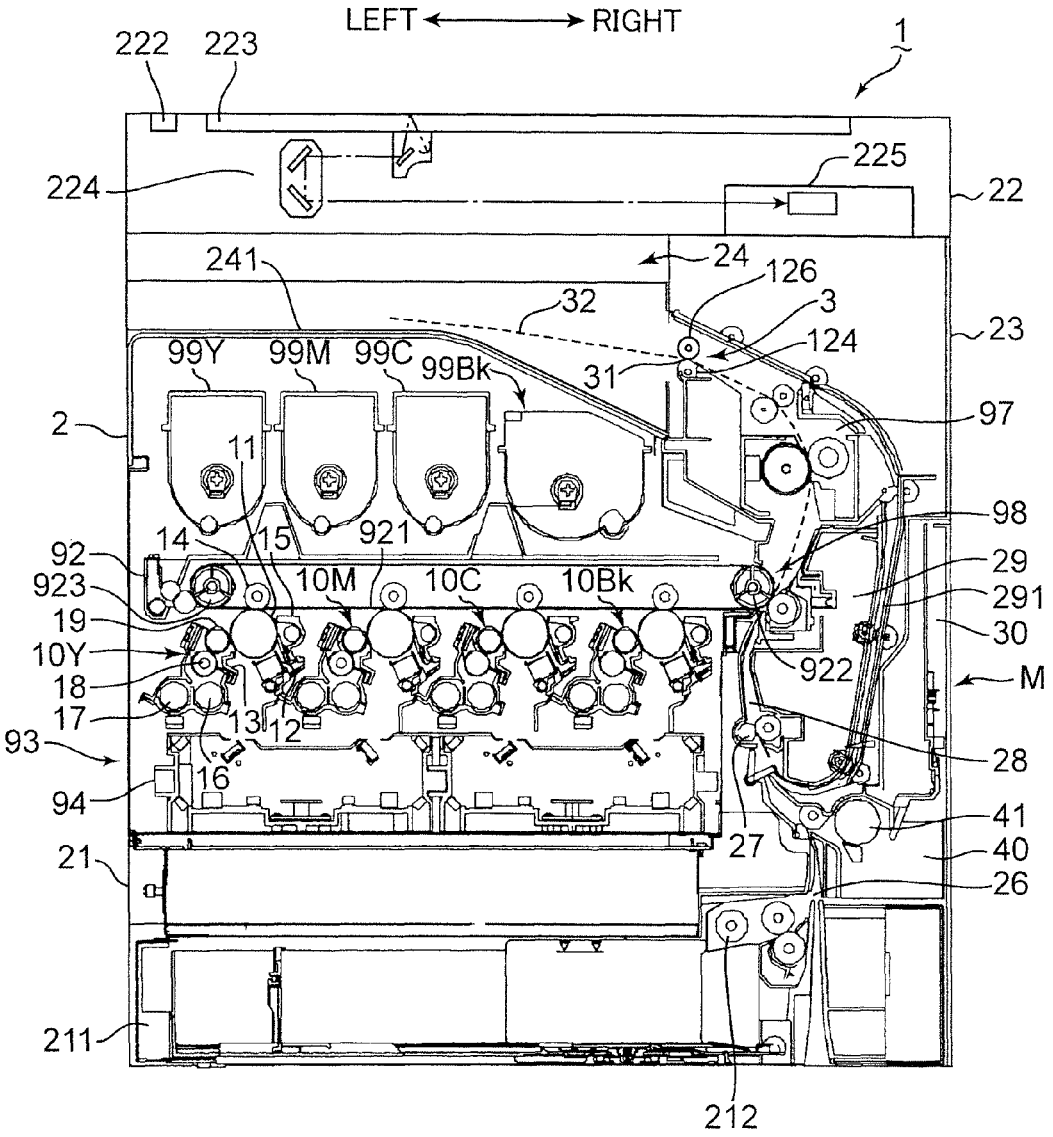
FIG. 2 is a sectional view showing the internal structure of the image forming apparatus shown in FIG. 1.

Hereinafter, an embodiment of the present disclosure is described based on the drawings. FIG. 1 is a perspective view showing the external appearance of an image forming apparatus 1 provided with a sheet discharging device according to one embodiment of the present disclosure. FIG. 2 is a sectional view showing the internal structure of the image forming apparatus 1 shown in FIG. 1. Although an internal discharge type copier is illustrated as the image forming apparatus 1 here, the image forming apparatus may be a printer, a facsimile machine or a complex machine provided with these functions.

The image forming apparatus 1 includes an apparatus main body 2 having a substantially rectangular parallelepipedic housing structure and including an internal space. The apparatus main body 2 performs an image forming process on a sheet. The apparatus main body 2 includes a substantially rectangular parallelepipedic lower housing 21, a substantially rectangular parallelepipedic upper housing 22 arranged above the lower housing 21, and a coupling housing 23 coupling the lower housing 21 and the upper housing 22. Various devices for image formation are housed in the lower housing 21, and various devices for optically reading a document image are housed in the upper housing 22. The internal space enclosed by the lower housing 21, the upper housing 22 and the coupling housing 23 serves as an internal sheet discharge portion 24 capable of storing sheets after image formation.

The coupling housing 23 is arranged on the right side surface of the apparatus main body 2. A sheet discharging device 3 for discharging a sheet to the internal sheet discharge portion 24 is provided in the coupling housing 23.

The internal space used as the internal sheet discharge portion 24 is open to the outside on the front and left surfaces of the apparatus main body 2. The bottom surface of the internal space is defined by the upper surface of the lower housing 21, and this upper surface forms a sheet tray 241. A sheet discharged from the sheet discharging device 3 is placed on the sheet tray 241.

An operation panel unit 25 projects from the front surface of the upper housing 22. The operation panel unit 25 is provided with operation keys 251 including a numerical keypad and a start key, an LCD touch panel 252 and the like. A pressing cover 226 (not shown in FIG. 2) for pressing a document whose image is to be read is arranged above the housing 22.

A sheet cassette 211 for storing sheets to which an image forming process is to be applied is mounted in the lower housing 21. The sheet cassette 211 can be pulled forward from the front surface of the lower housing 21. The sheet cassette 211 is a cassette provided for automatic sheet feeding.

A multi-tray unit M which enables a user to perform manual sheet feeding is attached to the right side surface of the apparatus main body 2. The multi-tray unit M includes a sheet feed tray 30 on which a sheet to be manually fed is to be placed and a sheet feeding unit 40 for carrying the manually placed sheet into an image forming station in the lower housing 21.

Next, the internal structure of the apparatus main body 2 is described based on FIG. 2. Toner containers 99Y, 99M, 99C and 99Bk, an intermediate transfer unit 92, an image forming station 93, an exposure unit 94 and the above sheet cassette 211 are successively housed from top in the lower housing 21.

The image forming station 93 includes four image forming units 10Y, 10M, 10C and 10Bk for forming respective toner images of yellow (Y), magenta (M), cyan (C) and black (Bk) to form a full-color toner image. Each of the image forming units 10Y, 10M, 10C and 10Bk includes a photoconductive drum 11 and a charger 12, a developing device 13, a primary transfer roller 14 and a cleaning device 15 arranged around this photoconductive drum 11.

The photoconductive drum 11 rotates about its shaft and an electrostatic latent image and a toner image are formed on the circumferential surface thereof. A photoconductive drum using an amorphous silicon (a-Si) based material can be used as the photoconductive drum 11. The charger 12 uniformly charges the circumferential surface of the photoconductive drum 11. The charged circumferential surface of the photoconductive drum 11 is exposed to light by the exposure unit 94 to form an electrostatic latent image.

The developing device 13 supplies toner to the circumferential surface of the photoconductive drum 11 to develop an electrostatic latent image formed on the photoconductive drum 11. The developing device 13 is for two-component developer and includes agitating rollers 16, 17, a magnetic roller 18 and a developing roller 19. The agitating rollers 16, 17 charge the toner by conveying the two-component developer in a circulating manner while agitating it. A two-component developer layer is carried on the circumferential surface of the magnetic roller 18 and a toner layer formed by the transfer of the toner due to a potential difference between the magnetic roller 18 and the developing roller 19 is formed on the circumferential surface of the developing roller 19. The toner on the developing roller 19 is supplied to the circumferential surface of the photoconductive drum 11 to develop the electrostatic latent image.

The primary transfer roller 14 forms a nip portion in cooperation with the photoconductive drum 11 by sandwiching an intermediate transfer belt 921 provided in the intermediate transfer unit 92, and primarily transfers a toner image on the photoconductive drum 11 to the intermediate transfer belt 921. The cleaning device 15 cleans the circumferential surface of the photoconductive drum 11 after the transfer of the toner image.

The yellow toner container 99Y, the magenta toner container 99M, the cyan toner container 99C and the black toner container 99Bk are respectively for storing toner of a corresponding color and supply the toners of YMCBk colors to the developing devices 13 of the image forming units 10Y, 10M, 10C and 10Bk corresponding to the respective colors through unillustrated supply paths.

The exposure unit 94 includes various optical devices such as light sources, polygon mirrors, reflecting mirrors and deflecting mirrors and forms an electrostatic latent image by irradiating light based on image data of a document image to the circumferential surface of the photoconductive drum 11 provided in each of the image forming units 10Y, 10M, 10C and 10Bk.

The intermediate transfer unit 92 includes the intermediate transfer belt 921, a drive roller 922 and a driven roller 923. Toner images from a plurality of photoconductive drums 11 are superimposed on the intermediate transfer belt 921 (primary transfer). The superimposed toner images are secondarily transferred to a sheet supplied from the sheet cassette 211 or the sheet feed tray 30 in a secondary transfer unit 98. The drive roller 922 and the driven roller 923 for driving and rotating the intermediate transfer belt 921 are rotatably supported on the lower housing 21.

The sheet cassette 211 stores a sheet stack formed by stacking a plurality of sheets. A pickup roller 212 is arranged above a right end side of the sheet cassette 211. By driving the pickup roller 212, the uppermost sheet of the sheet stack in the sheet cassette 211 is picked up one by one and carried into a carry-in conveyance path 26. On the other hand, a sheet manually placed on the sheet feed tray 30 is carried into the carry-in conveyance path 26 by driving a feed roller 41 of the sheet feeding unit 40.

A sheet conveyance path 28 extending up to the sheet discharging device 3 by way of the secondary transfer unit 98 and a fixing unit 97 to be described later is provided downstream of the carry-in conveyance path 26. An upstream part of the sheet conveyance path 28 is formed between an inner wall formed in the lower housing 21 and an inner wall forming the inner side surface of a reversing unit 29. Note that the outer side surface of the reversing unit 29 forms one side of a reversing conveyance path 291 for reversing and conveying a sheet in printing both sides of the sheet. A pair of registration rollers 27 are arranged upstream of the secondary transfer unit 98 in the sheet conveyance path 28. A sheet is temporarily stopped at the pair of registration rollers 27 and sent out to the secondary transfer unit 98 at a predetermined timing for image transfer after a skew correction is made.

The fixing unit 97 and the sheet discharging device 3 are housed in the coupling housing 23. The fixing unit 97 includes a fixing roller and a pressure roller and applies a fixing process by heating and pressing a sheet having a toner image secondarily transferred thereto in the secondary transfer unit 98. The sheet with the fixed color image is discharged from the fixing unit 97 to the sheet discharging device 3 via the sheet conveyance path 28.

The sheet discharging device 3 includes discharge rollers 124 driven by an unillustrated motor and driven rollers 126 forming a nip portion 31 (discharging portion) between the discharge rollers 124 and the driven rollers 126. The sheet discharging device 3 nips a sheet conveyed from the fixing unit 97 at the nip portion 31 and discharges it to the sheet tray 241 by driving and rotating the discharge rollers 124 and the driven rollers 126. In this way, a discharge path 32 extending from the secondary transfer unit 98 to the sheet tray 241 is formed by the sheet conveyance path 28 and the sheet discharging device 3. The nip portion is arranged in this discharge path 32.

A first contact glass 222 and a second contact glass 223 are fitted in the upper surface of the upper housing 22. A scanning mechanism 224 and an imaging element 225 for optically reading document information are housed in the upper housing 22. The scanning mechanism 224 includes a light source, a moving carriage, reflecting mirrors and the like and guides reflected light from a document to the imaging element 225. The imaging element 225 photoelectrically converts the reflected light into an analog electrical signal. The analog electrical signal is input to the exposure unit 94 after being converted into a digital electrical signal in an A/D converter circuit (not shown).

Figure 3:
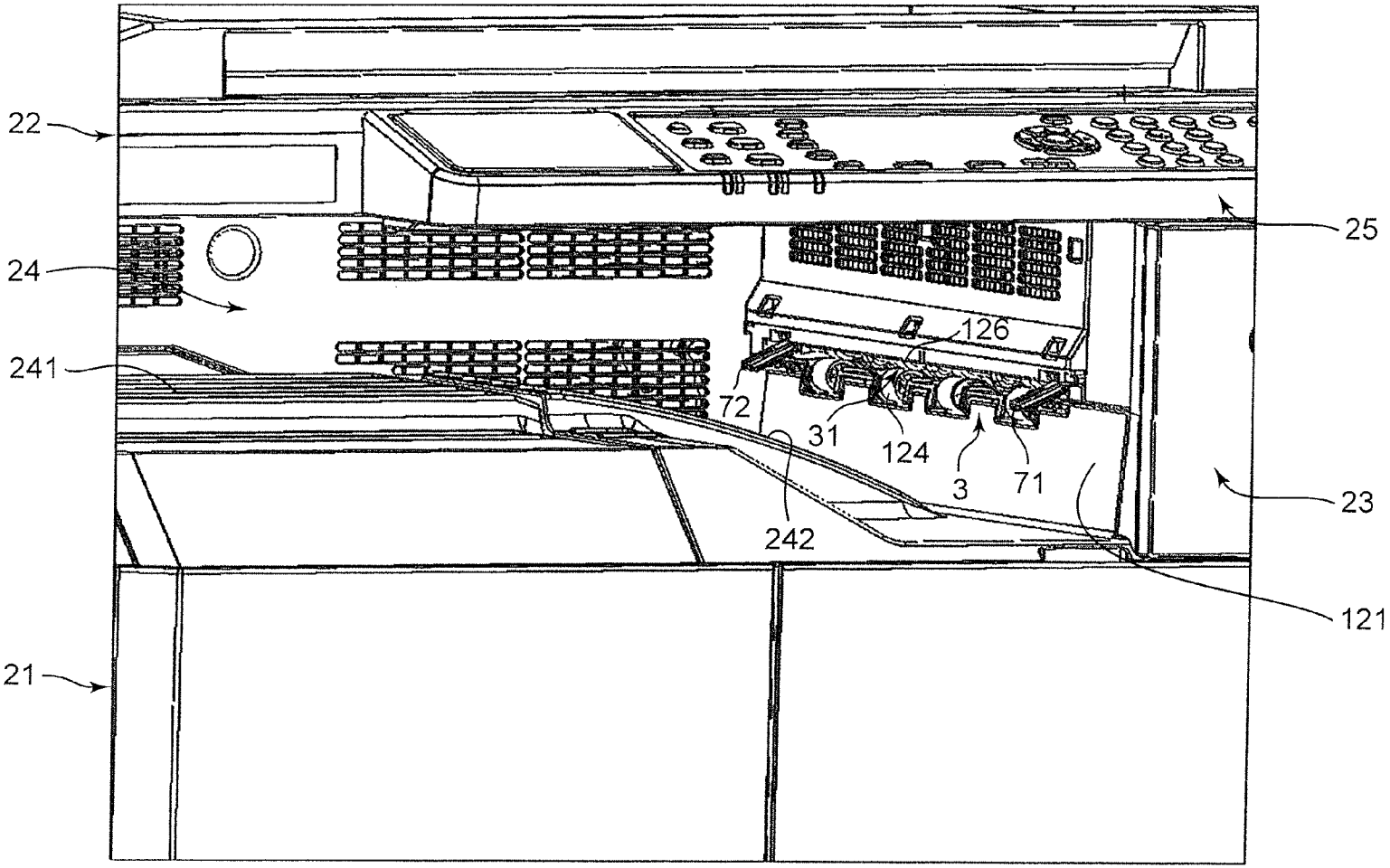
FIG. 3 is an enlarged view near a nip portion in the sheet discharging device.

FIG. 3 is an enlarged view near the nip portion 31 in the sheet discharging device 3. The coupling housing 23 includes an inner standing wall 121 facing the internal sheet discharge portion 24. The sheet tray 241 has an inclined surface 242 moderately inclined downward toward the inner standing wall 121. The sheet discharging device 3 discharges the sheet to the sheet tray 241 from the nip portion 31 provided in an opening of the inner standing wall 121.

The sheet discharging device 3 discharges the sheet from the nip portion 31 to the sheet tray 241 by applying a conveying force to the sheet. The sheet discharging device 3 includes the discharge rollers 124 for applying the conveying force to the sheet, the driven rollers 126, and a first pressing member 71 and a second pressing member 72 arranged downstream of the nip portion 31 between the discharge rollers 124 and the driven rollers 126 in a sheet discharging direction.

A sheet coming out of the nip portion 31 by driving the discharge rollers 124 is received onto the sheet tray 241. The user can insert his or her hand into the internal sheet discharge portion 24 and take out the sheet after image formation from the sheet tray 241.

Figure 4:
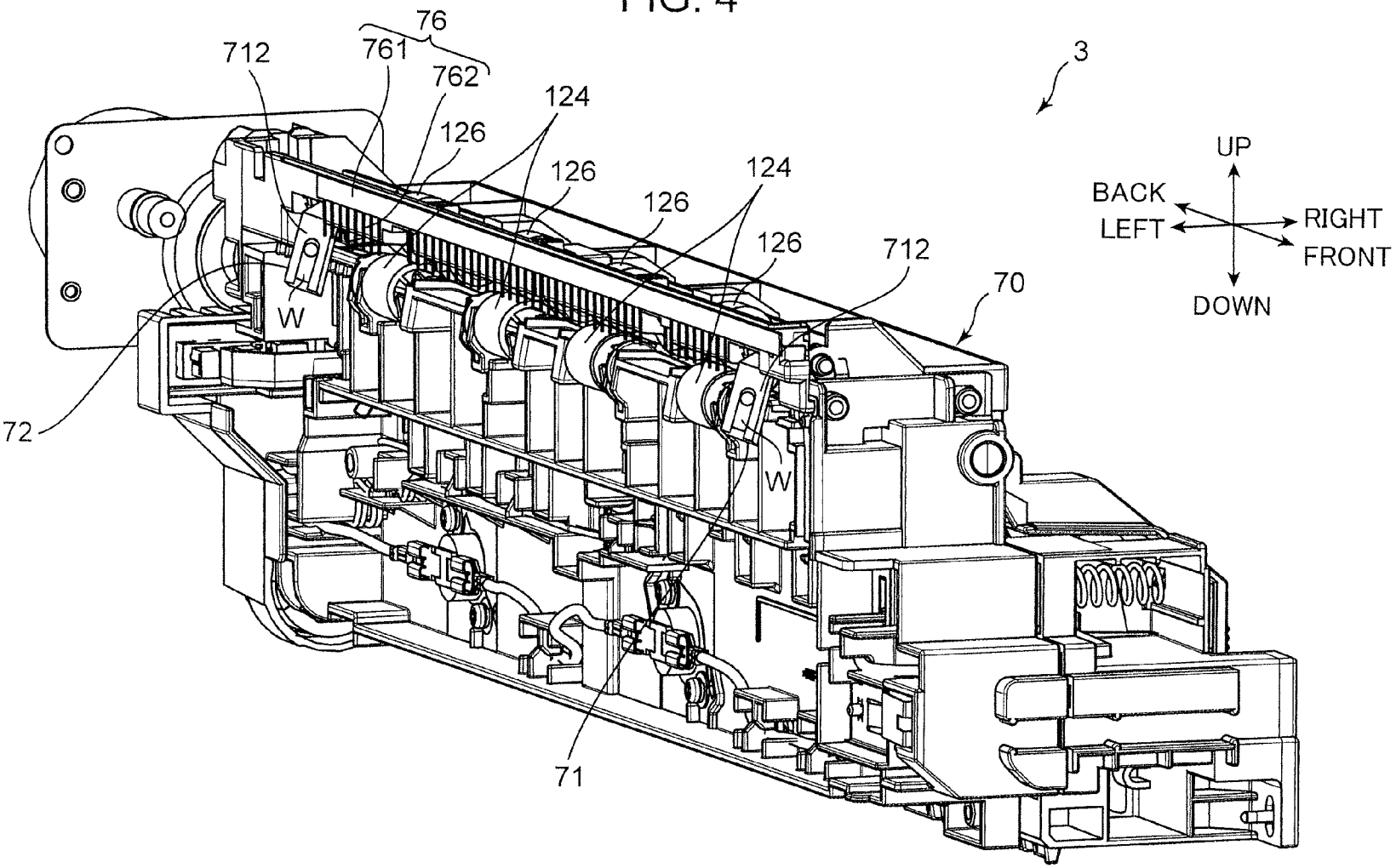
FIG. 4 is a perspective view of the sheet discharging device according to the embodiment of the present disclosure.
Figure 5:
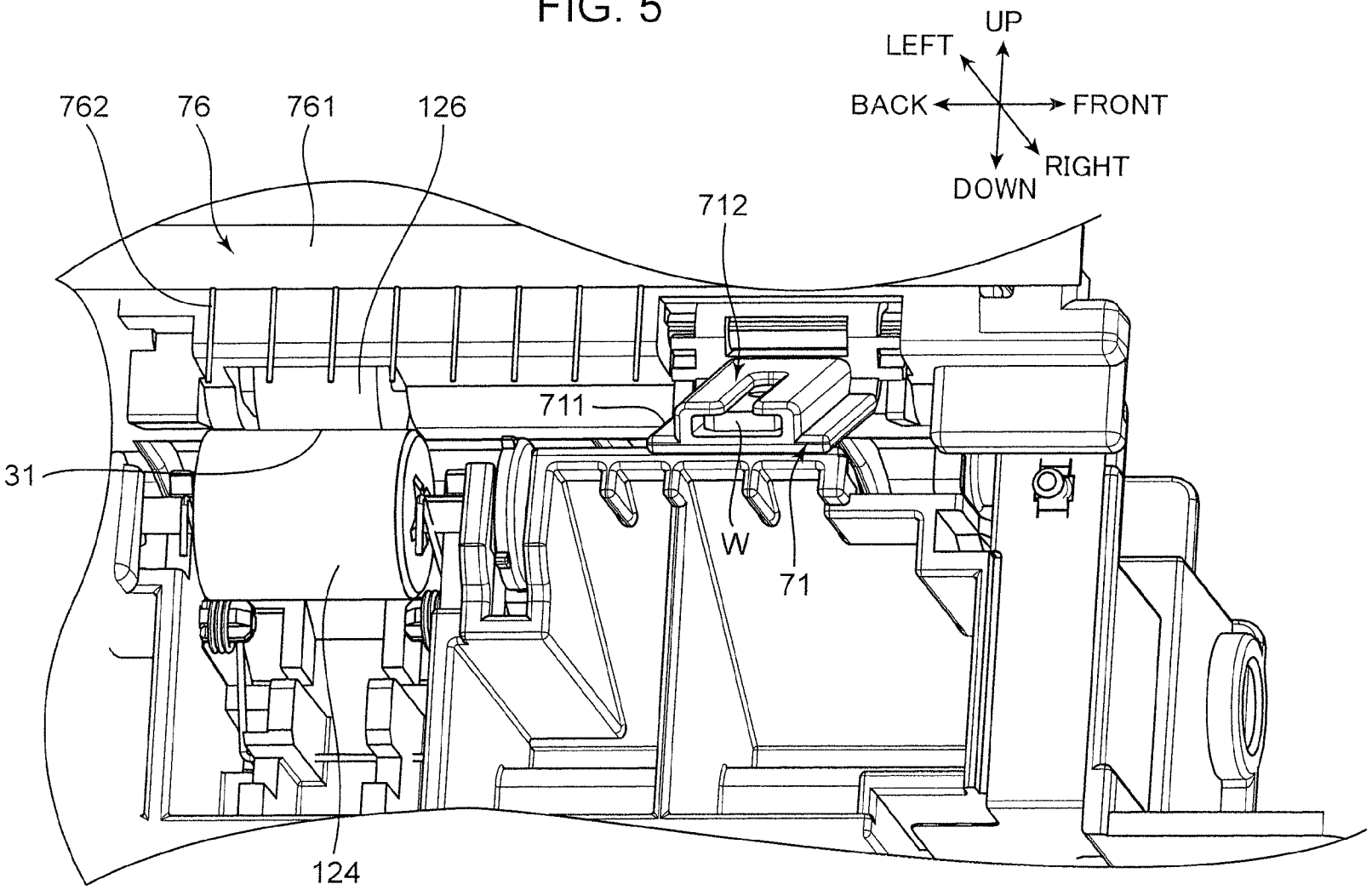
FIG. 5 is an enlarged view near a first pressing member in the sheet discharging device shown in FIG. 4.

The configuration of the sheet discharging device 3 according to the embodiment of the present disclosure is described in detail below with reference to FIGS. 4 to 11. FIG. 4 is a perspective view of the sheet discharging device 3 shown in FIG. 2. FIG. 5 is an enlarged view near the first pressing member 71 in the sheet discharging device 3 shown in FIG. 4.

The sheet discharging device 3 includes the discharge rollers 124, the driven rollers 126, the first pressing member 71, the second pressing member 72, a charge removal member 76 and a frame 70 holding these.

An unillustrated rotary shaft rotatably supported by the frame 70 and extending in a front-back direction (direction perpendicular to the sheet discharging direction) is mounted in the frame 70. The discharge rollers 124 are coaxially fixed to the unillustrated rotary shaft and rotated together with the unillustrated rotary shaft. The driven rollers 126 are arranged above the discharge rollers 124 to face the discharge rollers 124 and form the nip portion 31 between the discharge rollers 124 and the driven rollers 126.

When the discharge rollers 124 are rotated by the unillustrated drive motor, the driven rollers 126 rotate, following the rotation of the discharge rollers 124. This causes a sheet conveyed along the sheet conveyance path 28 to be nipped by the discharge rollers 124 and the driven rollers 126, conveyed leftward (sheet discharging direction) and discharged to the sheet tray 241.

The charge removal member 76 includes a bar-like member 761 extending in the front-back direction above the discharge rollers 124 and to the left of the driven rollers 126 (side to which the sheet is discharged) and conductive fibers 762 attached to the bar-like member 761. The bar-like member 761 is, for example, fixed to the frame 70 by screws, double-faced adhesive tape or the like. The conductive fibers 762 are a bundle of fiber-like conductive members.

A conductive sheet such as an aluminum foil or a metal plate is bonded to a surface of the bar-like member 761. This conductive sheet is grounded. A plurality of conductive fibers 762 are attached at predetermined intervals to this conductive sheet. The conductive fibers 762 are arranged across a discharge path for a sheet discharged from the discharge rollers 124. This causes the sheet discharged from the discharge rollers 124 to come into contact with the conductive fibers 762 and static electricity charged on the sheet to be guided from the conductive fibers 762 to the bar-like member 761, thereby removing charges from the sheet.

The first pressing member 71 is arranged at a position corresponding to the vicinity of one end part (front end) of an area for the passage of the sheet in a width direction perpendicular to the discharging direction and the second pressing member 72 is arranged at a position corresponding to the vicinity of the other end part (rear end) of this area. The first and second pressing members 71, 72 hang down from a shaft member 73 (see FIG. 8) arranged above the nip portion 31 in the frame 70. Each of the first and second pressing members 71, 72 is arranged downstream of the nip portion 31 in the sheet discharging direction and capable of changing a posture between a hanging posture where it hangs down from the shaft member 73, which is a pivot center located above the discharge path, to block the discharge path for sheet and a retracted posture where it is pivoted in the discharging direction about the pivot center to open the discharge path by receiving a pressing force in the discharging direction from the sheet.

FIG. 4 shows a state where the first and second pressing members 71, 72 are in the hanging posture. FIG. 5 shows a state where the first pressing member 71 is in the retracted posture.

Figure 6A:
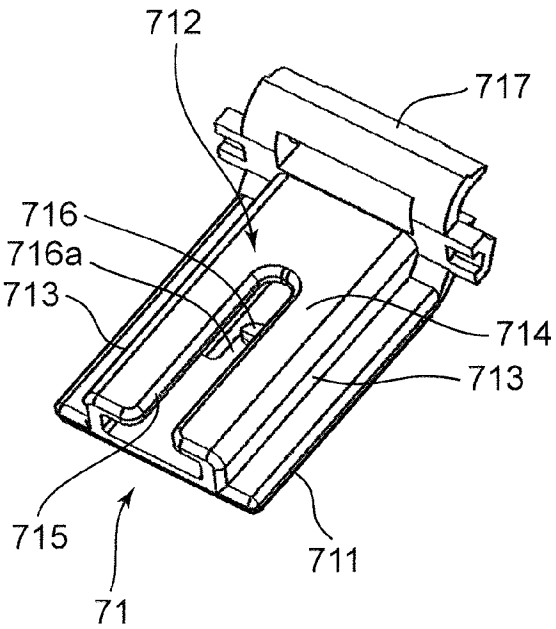
FIG. 6A is a perspective view of the first pressing member when viewed from above.
Figure 6B:
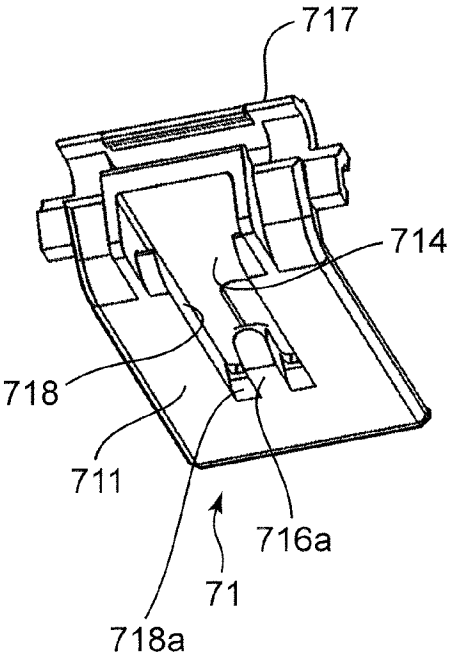
FIG. 6B is a perspective view of the first pressing member when viewed from below.
Figure 6C:
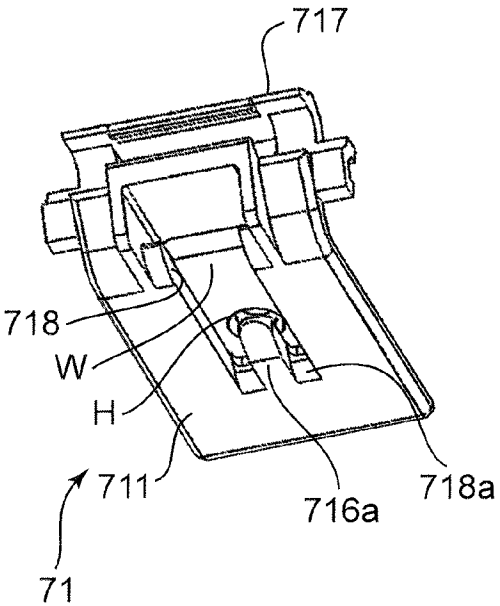
FIG. 6C is a perspective view of the first pressing member attached with a weight member when viewed from below.
Figure 7C:
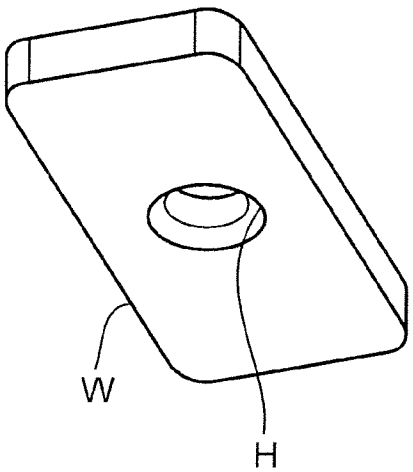
FIGS. 7A, 7B and 7C are perspective views each showing the shape of the weight member.
Figure 7B:
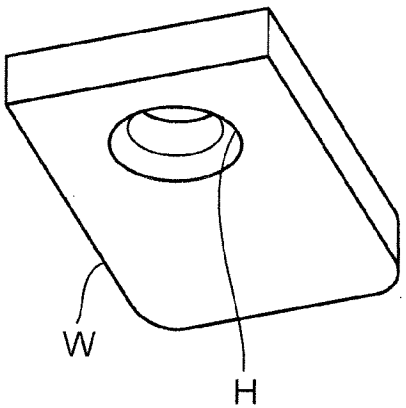
Figure 7A:
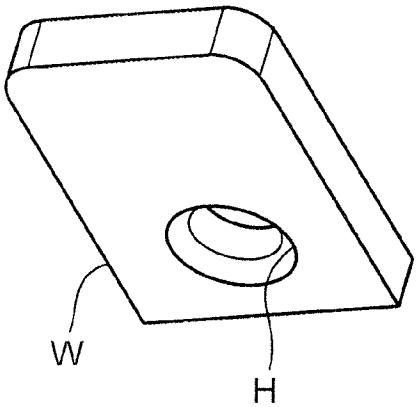
Figure 8:
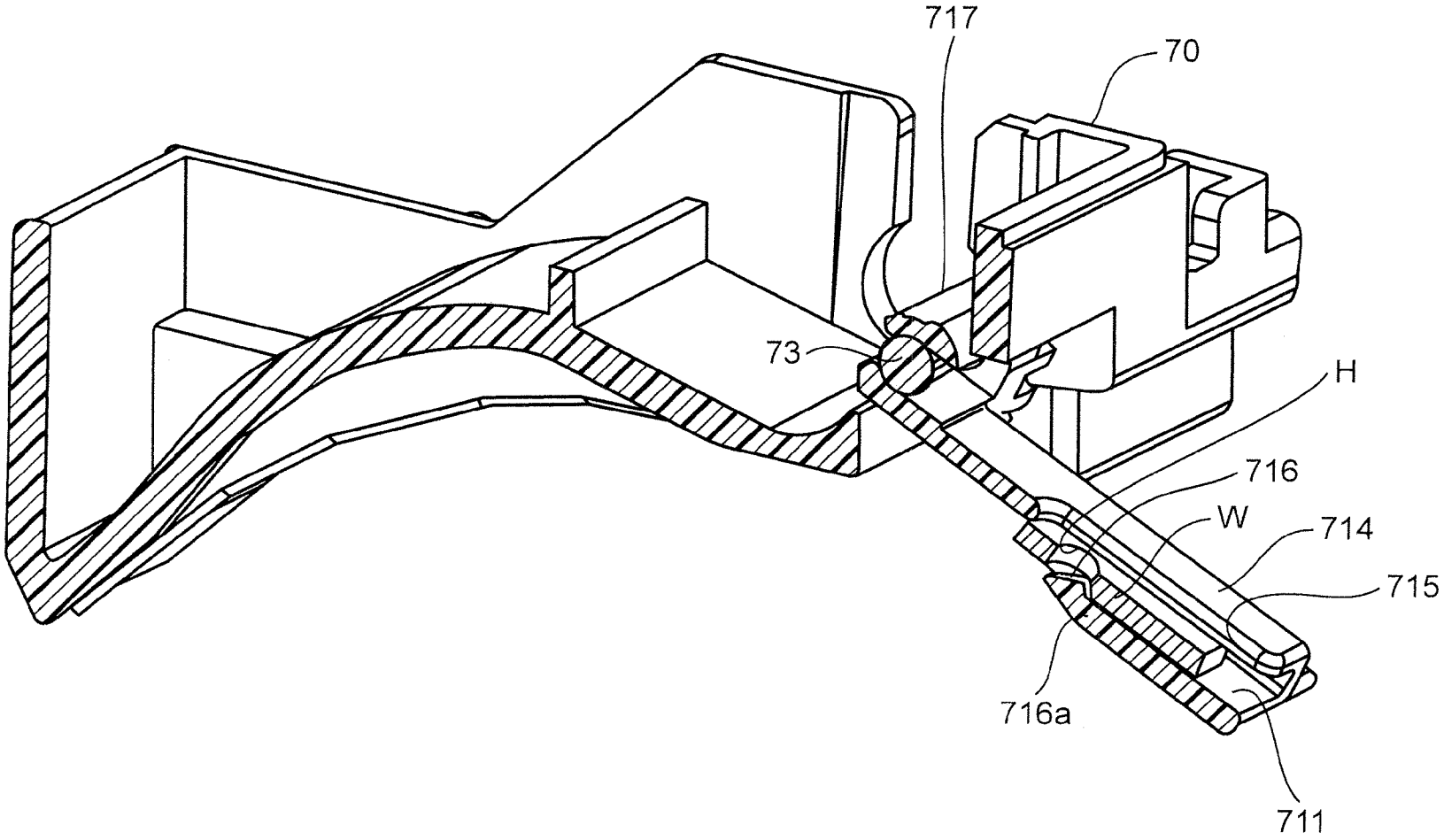
FIG. 8 is a partial sectional view of the pressing member and a frame in a state where the weight member is attached to the pressing member.

FIG. 6A is a perspective view of the first pressing member 71 when viewed from above, FIG. 6B is a perspective view of the first pressing member 71 when viewed from below, and FIG. 6C is a perspective view of the first pressing member 71 attached with a weight member W when viewed from below. FIG. 7 are perspective views each showing the shape of the weight member W, and FIG. 8 is a partial sectional view of the pressing member 71 and the frame 70 in a state where the weight member W is attached to the pressing member 71. Note that the second pressing member 72 is not described since being configured similarly to the first pressing member 71.

The first pressing member 71 includes a plate-like portion 711 and an attaching portion 712 for holding the weight member W having a predetermined weight on the upper surface of the plate-like portion 711. A rotational engaging portion 717 rotatably engaged with the shaft member 73 provided in the frame 70 is provided on the rear end of the plate-like portion 711.

The plate-like portion 711 is a plate-like member long in a direction away from the rotationally engaging portion 717 engaged with the shaft member 73 as the pivot center. The first pressing member 71 is so oriented that the lower surface (one surface) of the plate-like portion 711 faces an upstream side in the sheet discharging direction while being attached to the frame 70.

The attaching portion 712 includes a pair of wall portions 713, 713 erected from the upper surface (surface opposite to the one surface) of the plate-like portion 711 to extend in the direction away from the rotationally engaging portion 717, and a covering portion 714 bridging between the pair of wall portions 713, 713. When a user or an assembling operator inserts the weight member W into a space enclosed by a pocket formed by the plate-like portion 711, the pair of wall portions 713, 713 and the covering portion 714, the weight member W is held on the upper surface of the plate-like portion 711 by the attaching portion 712. The pocket has an opening for the insertion of the weight member W on an end part of the plate-like portion 711 in the direction away from the rotationally engaging portion 717.

The attaching portion 712 holds the weight member W while surrounding it by the plate-like portion 711, the pair of wall portions 713, 713 and the covering portion 714, whereby a possibility that the weight member W comes off from the attaching portion 712 can be reduced.

The plate-like portion 711 is formed with a substantially rectangular cut portion 718 extending from the side of the rotationally engaging portion 717 toward a tip. The cut portion 718 has a side 718*a* facing the rotationally engaging portion 717, and an arm portion 716*a* projects toward the rotationally engaging portion 717 from the side 718*a*. A projection 716 (engaging portion) projecting toward the upper surface of the plate-like portion 711 is formed on the projecting tip of the arm portion 716*a*. The projection 716 is provided at a substantially central position of the plate-like portion 711 in the direction away from the rotationally engaging portion 717, i.e. longitudinal direction of the plate-like portion 711.

The covering portion 714 is formed with a rectangular cut portion 715 extending from a side of the covering portion 714 away from the rotationally engaging portion 717, i.e. a tip side, to a position facing the projection 716. By forming the cut portion 715 in the covering portion 714, the assembling operator or the user can insert a bar-like tool into the cut portion 715. As a result, the assembling operator or the user can easily attach the weight member W to the attaching portion 712 and detach the weight member W from the attaching portion 712 using the bar-like tool.

The weight member W is, for example, made of a metal having a large specific gravity such as iron or lead. The weight member W is a long plate-like member having a substantially rectangular shape. The weight member W is attached to each of the first and second pressing members 71, 72 in such an orientation that a longitudinal direction of the plate-like portion 711 and that of the weight member W match.

The weight member W is formed with a through hole H (engaged portion) to be engaged with the projection 716. As shown in FIGS. 7A and 7B, the through hole H is provided at a position away from a center-of-gravity position of the weight member W along the longitudinal direction of the weight member W. Specifically, the through hole H is arranged at the position away from the center-of-gravity position of the weight member W in a direction away from the pivot center in a state where the weight member W is attached to the attaching portion 712.

When the weight member W is attached to the attaching portion 712, the projection 716 is fitted into the through hole H due to an elastic force of the arm portion 716*a*. As a result, the through hole H is engaged with the projection 716 to determine the attached position of the weight member Win the first or second pressing members 71, 72.

Figure 9:
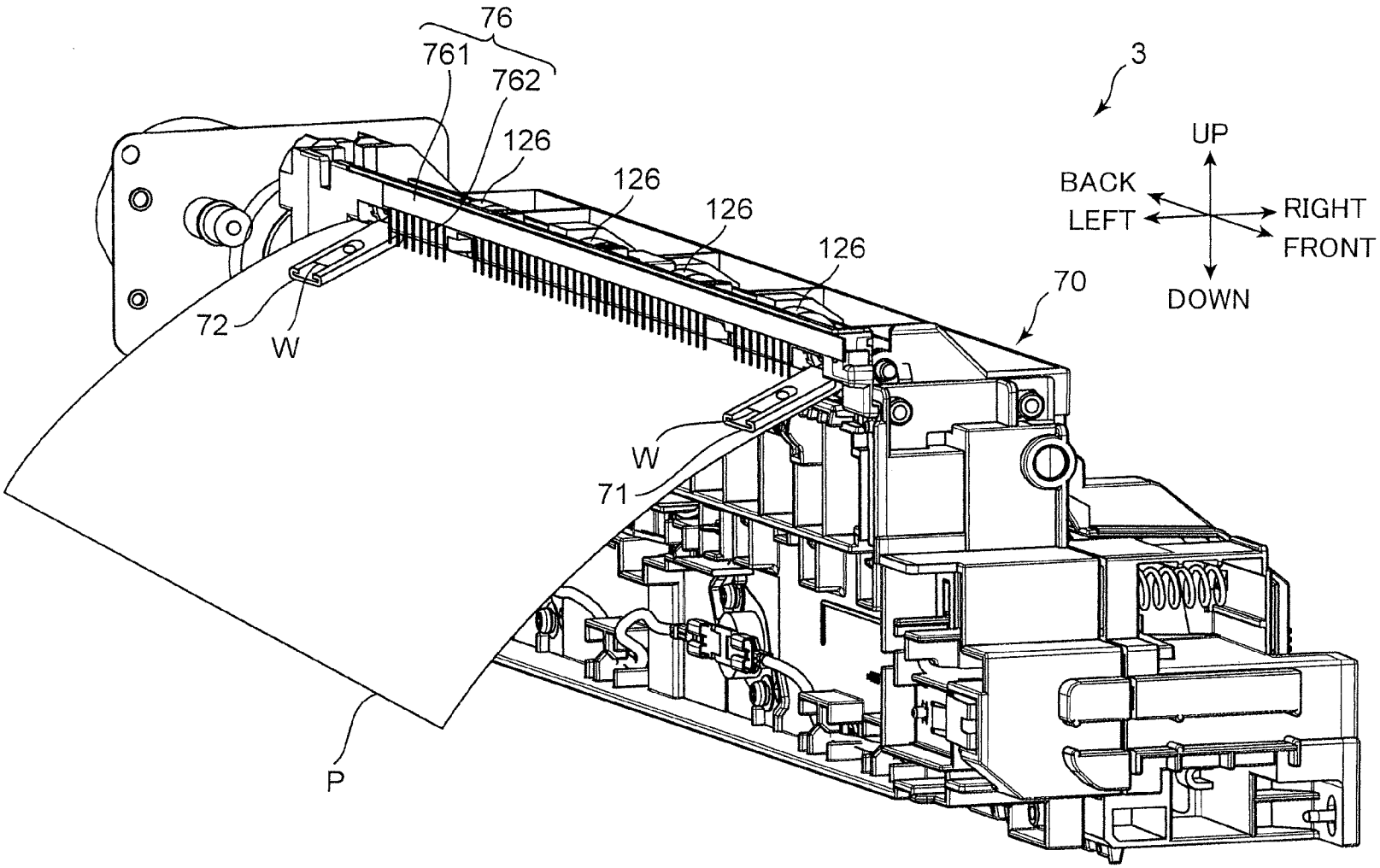
FIG. 9 is a perspective view showing a state where a sheet is discharged from the sheet discharging device.

FIG. 8 shows a state where the weight member W shown in FIG. 7B is so attached that the center of gravity thereof is located on a tip side of the first pressing member 71. FIG. 9 is a perspective view showing a state where a sheet P is discharged from the sheet discharging device 3 shown in FIG. 4.

When the sheet P is discharged from the sheet discharging device 3, the first and second pressing members 71, 72 are pivoted in the discharging direction about the shaft member 73 by receiving a pressing force in the discharging direction from the sheet P, thereby assuming the retracted posture to open the discharge path. At this time, if the weight members W are so attached to the first and second pressing members 71, 72 that the centers of gravity are located on the tip sides of the first and second pressing members 71, 72 as shown in FIG. 7B, distances from the shaft member 73 to the centers of gravity of the weight members W become longer. As a result, forces of the first and second pressing members 71, 72 for pressing the sheet P increase.

On the other hand, if the weight members W are attached in an orientation shown in FIG. 7A into the first and second pressing members 71, 72, the centers of gravity of the weight members W are located on the side of the shaft member 73 and distances from the shaft member 73 to the centers of gravity of the weight members W become shorter. As a result, forces of the first and second pressing members 71, 72 for pressing the sheet P decrease.

As just described, according to the weight members W shown in FIGS. 7A and 7B, the forces of the first and second pressing members 71, 72 for pressing the sheet P can be adjusted by changing the attaching orientations of the weight members W into the first and second pressing members 71, 72. Here, attached positions in the case of attaching the weight members W into the first and second pressing members 71, 72 such that the centers of gravity of the weight members W are located on the side of the shaft member 73 are referred to as first positions. Further, attached positions in the case of attaching the weight members W into the first and second pressing members 71, 72 such that the centers of gravity of the weight members W are located on the tip sides of the first and second pressing members 71, 72 are referred to as second positions. In this case, the attaching portion 712 can attach the weight member W at the first position away from the pivot center by a first distance and at the second position away from the pivot center by a second distance longer than the first distance.

If the weight member W is attached at the second position to locate the center-of-gravity position of the weight member W away from the pivot center, a moment of a force acting as the pressing force for the sheet P increases. If the weight member W is attached at the first position to locate the center-of-gravity position of the weight member W close to the pivot center, a moment of a force acting as the pressing force for the sheet P decreases. Thus, a pressing force applied to the sheet P can be easily adjusted by changing the attaching orientations of the weight members W into the first and second pressing members 71, 72 according to properties of the sheet such as the thickness of the sheet P, the hardness of the sheet P or the easiness to curl of the sheet P.

Thus, the pressing force can be easily adjusted according to the destination of the image forming apparatus 1. For example, in the image forming apparatus 1 for Japanese domestic market where relative thin sheets are frequently used as the sheet P, the weight members W are so attached to the first and second pressing members 71, 72 that the centers of gravity of the weight members W are located on the side of the shaft member 73. This enables the forces of the first and second pressing members 71, 72 for pressing the sheet P to be decreased and adjusted so that a pressing force suitable for thin sheets is applied to the sheet P.

On the other hand, in the image forming apparatus 1 for European market where relatively thick sheets are frequently used as the sheet P, the weight members W are so attached to the first and second pressing members 71, 72 that the centers of gravity of the weight members W are located on the tip sides of the first and second pressing members 71, 72. This enables the forces of the first and second pressing members 71, 72 for pressing the sheet P to be increased and adjusted so that a pressing force suitable for thick sheets is applied to the sheet P. Alternatively, a user can maneuver to change the orientations of the weight members W according to sheets P to be used.

Further, the first and second pressing members 71, 72 are arranged at the positions respectively corresponding to the vicinities of the opposite end parts of the sheet P in the width direction perpendicular to the discharging direction. Thus, the vicinities of opposite corners of a trailing end part of the sheet P that most tend to be lifted can be pressed down by the first and second pressing members 71, 72, wherefore an effect of preventing the lift of the trailing end of the sheet increases.

In the above embodiment, the through hole H is provided at the position away from the center-of-gravity position of the weight member W along the longitudinal direction of the weight member W. As shown in FIG. 7C, the position of the through hole H may match the center-of-gravity position of the weight member W.

Even in this case, the forces of the first and second pressing members 71, 72 for pressing the sheet P can be easily adjusted, for example, depending on whether or not the weight members W are attached to the first and second pressing members 71, 72. Alternatively, a plurality of weight members W having mutually different weights can be prepared, and the forces of the first and second pressing members 71, 72 for pressing the sheet P can be easily adjusted by changing the weights of the weight members W attached to the first and second pressing members 71, 72.

Note that even if the through hole H is provided in the center of the weight member W as shown in FIG. 7C, the center of gravity of the weight member W may be located at a position away from the position of the through hole H along the longitudinal direction of the weight member W, for example, by a method of changing the thickness of the weight member W depending on the position. In this case, similarly to the weight members W shown in FIGS. 7A and 7B, the forces of the first and second pressing members 71, 72 for pressing the sheet P can be easily adjusted by changing the attaching orientations of the first and second pressing members 71, 72.

Figure 10:
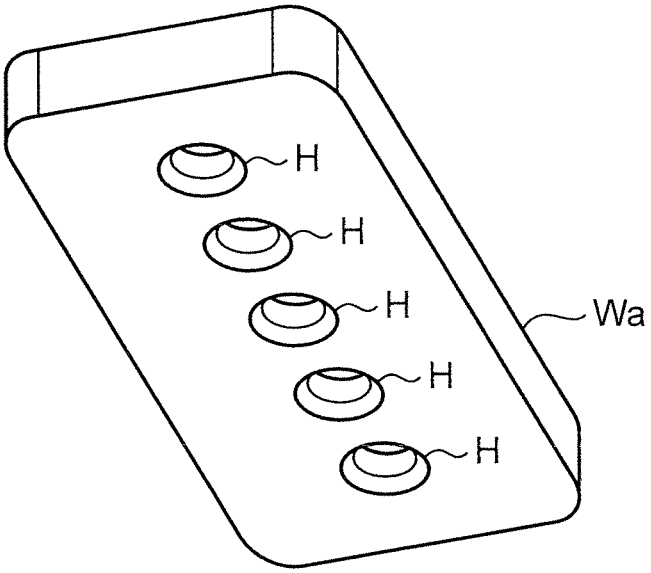
FIG. 10 is a perspective view showing another example of the weight member.

FIG. 10 is a perspective view showing a weight member Wa according to another example. The weight member Wa is provided with a plurality of through holes H along a longitudinal direction of the weight member Wa. The plurality of through holes H are arranged in a direction away from a pivot center in a state where the weight member Wa is attached to the attaching portion 712.

According to the weight member Wa, the forces of the first and second pressing members 71, 72 for pressing the sheet P can be easily adjusted by changing the through holes H to be engaged with the projections 716.

Figure 11:
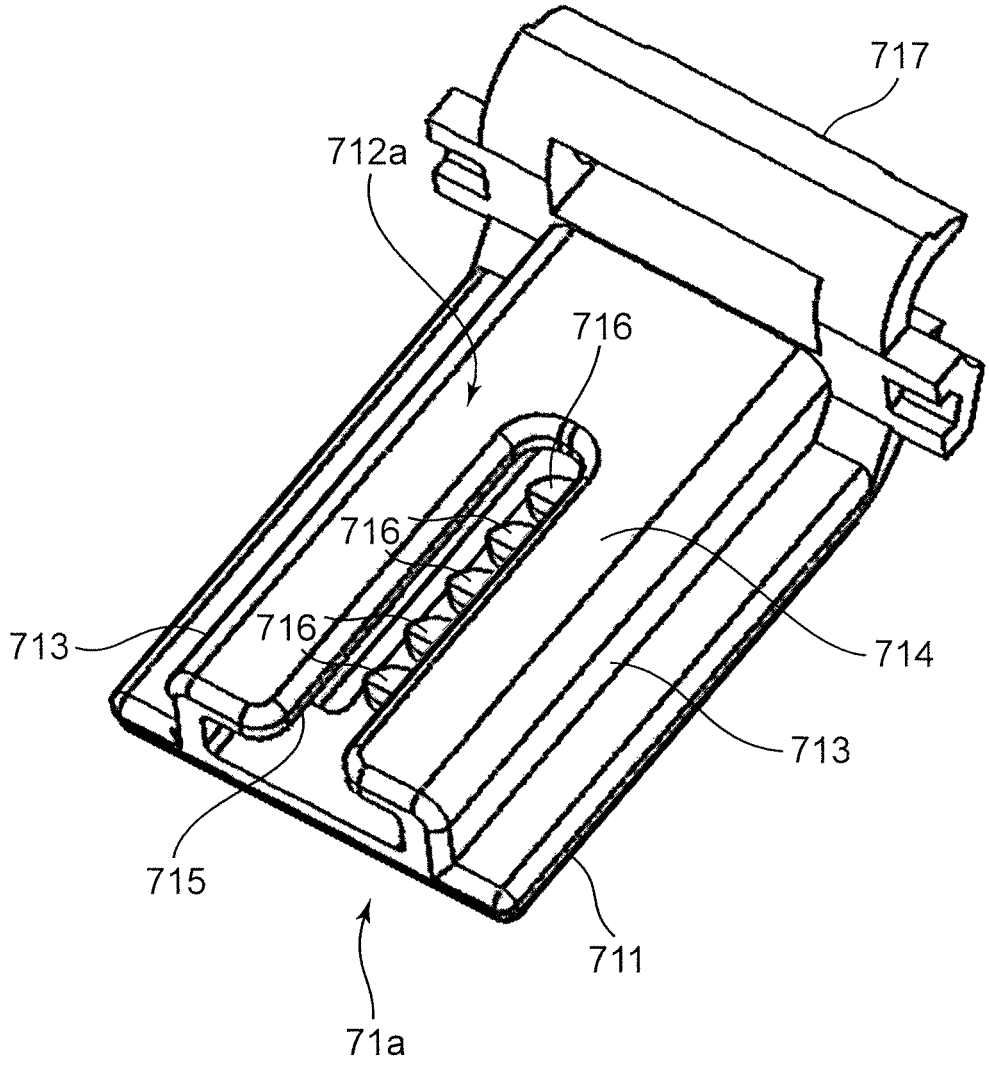
FIG. 11 is a perspective view showing another example of the first pressing member.

FIG. 11 is a perspective view showing a first pressing member 71*a* according to another example of the first pressing member 71 (second pressing member 72) shown in FIG. 6. As in the first pressing member 71*a* shown in FIG. 11, a plurality of projections 716 may be arranged in a direction away from the rotational engaging portion 717 engaged with the shaft member 73 as the pivot center.

According to the first pressing member 71*a*, the forces of the first and second pressing members 71, 72 for pressing the sheet P can be easily adjusted by changing the projections 716 to be engaged with the through holes H.

Further, a through hole may be provided as an engaging portion instead of the projection 716 in the first pressing members 71, 71*a* shown in FIGS. 6 and 11, and a projection may be provided as an engaged portion instead of the through hole H in the weight members W, Wa shown in FIGS. 7 and 10. Also with this arrangement, effects similar to those of the first pressing members 71, 71*a* shown in FIGS. 6 and 11 and the weight members W, Wa shown in FIGS. 7 and 10 are obtained.

Further, the sheet discharging device 3 is not limited to its application in the image forming apparatus 1. For example, the sheet discharging device 3 may be provided in a scanner for reading a document image or other apparatuses.

According to the sheet discharging device and the image forming apparatus according to the present disclosure described above, a pressing force applied to a sheet can be easily adjusted according to properties of the sheet.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A sheet discharging device for discharging a sheet to a sheet tray on which the sheet is to be placed, comprising:

a discharge path configured to discharge the sheet to the sheet tray;

a discharging portion arranged in the discharge path and configured to discharge the sheet passing along the discharge path to the sheet tray; and a pressing member capable of changing a posture between a hanging posture where the pressing member hangs down from a pivot center above the discharge path so as to block the discharge path for the sheet and a retracted posture where the pressing member is pivoted in a discharging direction about the pivot center to open the discharge path by receiving a pressing force in the discharging direction from the sheet;

a weight member having a predetermined weight, wherein the pressing member includes a plate-like portion including a tip end, a rear end and a cut portion extending from the rear end to the tip end, an attaching portion attaching the weight member to the plate-like portion and a rotationally engaging portion provided on the rear end of the plate-like portion and rotationally engaged with a member as a pivot center, the attaching portion includes an elastically deformable arm portion projecting toward the rotationally engaging portion from a side of the plate-like portion that faces the rotationally engaging portion across the cut portion, and an engaging portion to be engaged with the weight member to determine an attached position of the weight member, the engaging portion is a projecting piece that projects from the arm portion, the weight member includes an engaged portion to be engaged with the engaging portion, the engaged portion is a hole into which the projecting piece is insertable, the engaged portion is provided at a position away from a center-of-gravity position of the weight member in a direction away from the pivot center in a state where the weight member is attached to the attaching portion, the plate-like portion has a first surface to come into contact with the sheet and a second surface opposite to the first surface, and an inclined surface at a projecting tip end of the arm portion and inclined from the first surface to the second surface.

2. A sheet discharging device according to claim 1, wherein:

the weight member includes a plurality of holes to be engaged with the engaging portion; and the plurality of holes are arranged in a direction away from the pivot center in a state where the weight member is attached to the attaching portion.

3. A sheet discharging device according to claim 1, wherein:

the attaching portion includes a plurality of engaging portions to be engaged with the weight member to determine an attached position of the weight member; and the plurality of engaging portions are arranged in a direction away from the pivot center.

4. A sheet discharging device according to claim 1, wherein:

the attaching portion includes:

a pair of wall portions erected on the second surface of the plate-like portion to extend in the direction away from the rotationally engaging portion, and a covering portion bridging between the pair of wall portions; and the weight member is held in an enclosed space defined by the plate-like portion, the pair of wall portions and the covering portion.

5. A sheet discharging device according to claim 1, wherein the pressing member includes:

a pocket that defines an enclosed space and is arranged on ache second surface of the plate-like portion and capable of accommodating the weight member, the pocket including an opening for the insertion of the weight member on an end side of the plate-like portion in the direction away from the rotationally engaging portion.

6. A sheet discharging device according to claim 1, wherein:

the pressing member includes a first pressing member and a second pressing member; and the first pressing member is arranged at a position corresponding to the vicinity of one end part of an area for the passage of the sheet in a width direction perpendicular to the discharging direction and the second pressing member is arranged at a position corresponding to the vicinity of another end part of the area.

7. An image forming apparatus, comprising:

a sheet tray on which a sheet is to be placed;

a sheet discharging device according to claim 1; and an image forming unit for forming an image on the sheet;

wherein the sheet discharging device discharges the sheet having the image formed thereon by the image forming unit to the sheet tray.

8. An image forming apparatus, comprising:

a sheet tray on which a sheet is to be placed;

a sheet discharging device according to claim 2; and an image forming unit for forming an image on the sheet;

wherein the sheet discharging device discharges the sheet having the image formed thereon by the image forming unit to the sheet tray.

9. An image forming apparatus, comprising:

a sheet tray on which a sheet is to be placed;

a sheet discharging device according to claim 3; and an image forming unit for forming an image on the sheet;

wherein the sheet discharging device discharges the sheet having the image formed thereon by the image forming unit to the sheet tray.

10. An image forming apparatus, comprising:

a sheet tray on which a sheet is to be placed;

a sheet discharging device according to claim 4; and an image forming unit for forming an image on the sheet;

wherein the sheet discharging device discharges the sheet having the image formed thereon by the image forming unit to the sheet tray.

11. An image forming apparatus, comprising:

a sheet tray on which a sheet is to be placed;

a sheet discharging device according to claim 5; and an image forming unit for forming an image on the sheet;

wherein the sheet discharging device discharges the sheet having the image formed thereon by the image forming unit to the sheet tray.

12. An image forming apparatus, comprising:

a sheet tray on which a sheet is to be placed;

a sheet discharging device according to claim 6; and an image forming unit for forming an image on the sheet;

wherein the sheet discharging device discharges the sheet having the image formed thereon by the image forming unit to the sheet tray.

* * * * *